US005544758A

United States Patent [19]

Malatesta et al.

[11] Patent Number: 5,544,758

[45] Date of Patent: Aug. 13, 1996

[54] MAIL APERTURE ASSEMBLY FOR MAIL SORTING SYSTEM

[75] Inventors: James Malatesta; Marsha Pohl, both of Hockessin, Del.

[73] Assignee: Promer, Inc., Wilmington, Del.

[21] Appl. No.: 264,906

[22] Filed: Jun. 24, 1994

[51] Int. Cl.[6] ..... B07C 5/00

[52] U.S. Cl. ..... 209/584; 209/900

[58] Field of Search ..... 209/584, 539, 209/900, 903, 918; 250/491.1

[56] References Cited

U.S. PATENT DOCUMENTS

| | | | |
|---|---|---|---|
| 4,090,611 | 5/1978 | McKinney | 209/584 X |
| 4,456,127 | 6/1984 | Hams | 209/584 X |
| 4,607,833 | 8/1986 | Svyatsky et al. | 209/900 X |
| 4,886,596 | 12/1989 | Sasage et al. | 209/900 X |
| 5,288,994 | 2/1994 | Berson | 209/584 X |

*Primary Examiner*—D. Glenn Daydan
*Attorney, Agent, or Firm*—Connolly & Hutz

[57] ABSTRACT

A mail aperture assembly for a mail sorting system includes a long, narrow aperture mounted on a transport surface. The assembly includes at least two surfaces and a belt mounted juxtaposed to the aperture. A belt is in contact with at least two surfaces of the aperture. At least one surface is not in the same plane as the aperture, preferably in the direction of the belt.

12 Claims, 3 Drawing Sheets

14
13
15
2
1
1
12
3
64
4
50
6
10
52
1
14
5
51
2
1
4
6B
6C

MAIL APERTURE ASSEMBLY FOR MAIL SORTING SYSTEM

BACKGROUND OF THE INVENTION

With the ever increase of optical character reading and bar code reading of mail great efforts have been expended to manufacture mail with the address and bar code information easily visible. If, for example, a company such as a bank or a direct mail advertising company could produce a plastic windowed envelope or a plastic envelope which could allow the address or bar code information on the contents to show through then advantage could be taken of the generic envelope. With such a generic nature, the significant cost savings on envelopes which would be desirable if a mail sorting system could have a high speed and efficient aperture assembly to eliminate glare from the optical character reader and bar code reader light and facilitate the viewing by an optical character reader or bar code reader through the plastic to the contents inside.

SUMMARY OF THE INVENTION

An object of this invention is to prove a mail aperture assembly which is particularly adapted for use with a high speed mail sorting system that eliminates glare from the known optical character reader and bar code reader light on plastic windowed envelopes and plastic covered items of mail so as to facilitate accurate view by an optical character reader or bar code reader through the envelope to the contents inside.

A further object of this invention is to provide a mail aperture assembly capable of handling plastic windowed and plastic covered items of mail over a wide range of coverings.

A still further object of this invention is to provide such a mail aperture assembly which is efficient in operation with minimal parts, minimal removal of paper dust and minimal maintenance requirements.

In accordance with this invention, the mail aperture assembly includes a long and narrow aperture juxtaposed to at least two surfaces parallel but not in the same plane and a belt tensioned onto both surfaces. The first surface on one side of the aperture is in the same plane as the aperture. The second surface is in an offset plane and on the other side of the aperture in the direction of the belt away from the aperture. The joining point of the first and second surfaces is accomplished so that the mail piece can move at high speed along the first surface and at high speed move up onto the second surface away from the aperture. The mail is driven across the aperture and bent back towards the first surface on the opposite side of the aperture by the belt tensioned onto both surfaces. The bend in the mail piece flattens the window and plastic covering against the address and bar code information on the contents inside the envelope eliminating wrinkles and folds and preventing the optical character reader and bar code reader light from creating glare in the line of view of the optical character reader and bar code reader on the contents inside the envelope.

The preferred practice of the invention, the long and narrow aperture can be an open space without any lens material that could be scratched by the items of mail at high speed. The point of the bend in the mail piece where the second surface ends is where the optical character reader and bar code reader view the flattened plastic window and plastic covered item of mail.

Advantageously, the graduation between the two surfaces has the multiple function of acting as a bending point about which all types of mail pieces can be transported at high speed.

DETAILED DESCRIPTION

The present invention is directed to a mail aperture assembly, particularly designed for use with a high speed automated mail sorting system such as the 91-5 Ultrasorter optical character reader bar code sorting system. Reference is made to the system of U.S. Pat. No. 5,226,547, the details of which are incorporated herein by reference thereto. In particular, however, the present invention is intended to improve the rate of read of the mail sorting system of the optical character reader and bar code reader.

FIGS. 1–4 illustrate the mail aperture assembly 10 in accordance with this invention. As shown therein at least two surfaces 1, 1A are provided juxtaposed with aperture 2.

Figures 1, 3:
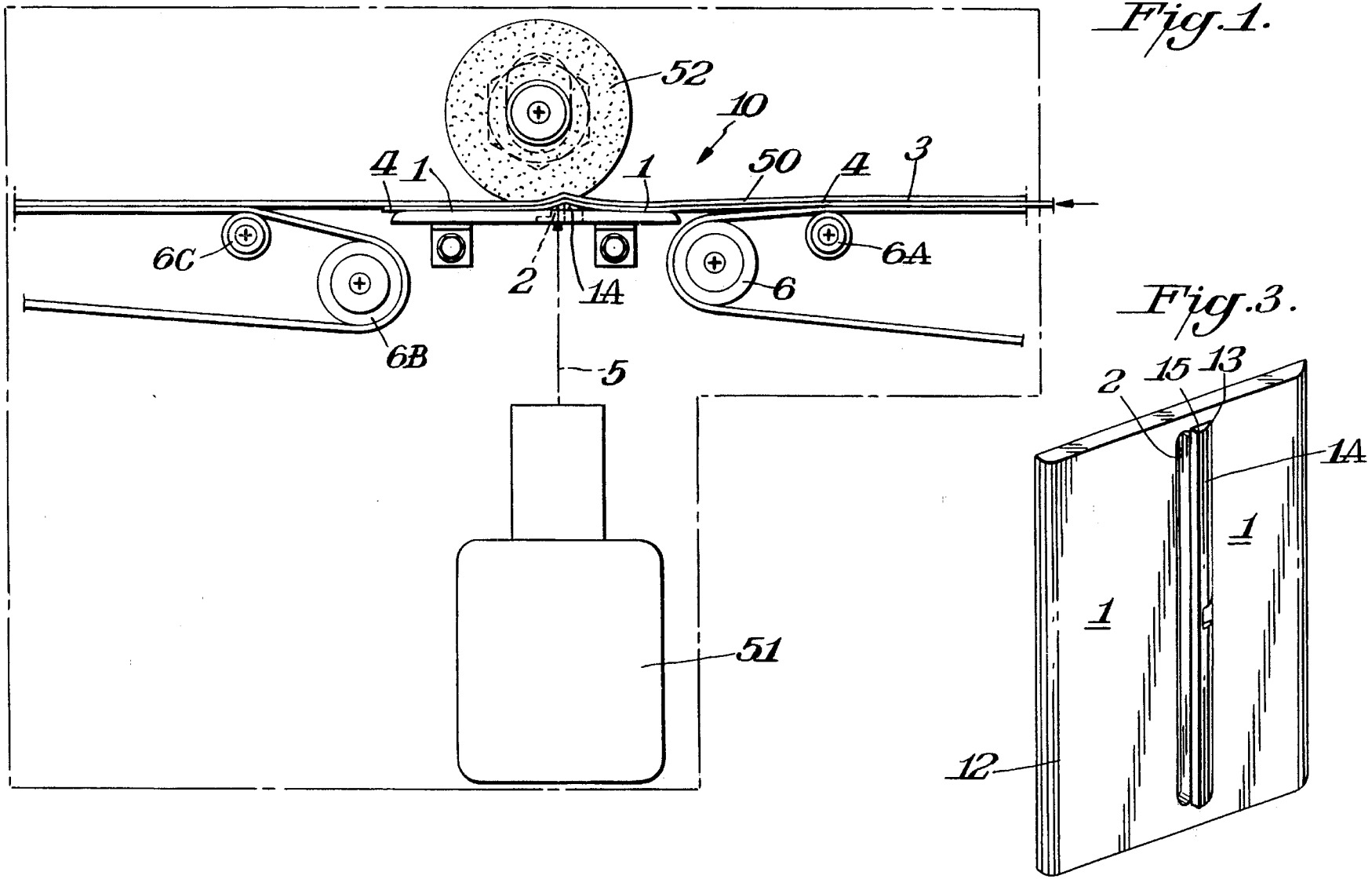
FIG. 1 is a top plan view of a mail aperture assembly in accordance with this invention incorporated in a high speed automated mail sorter system.
FIG. 3 is a perspective view of the mail aperture plate of FIGS. 1–2.

Also illustrated in FIG. 1, the run 50 of belt 3 is tensioned against upstream surfaces 1, 1A. The various rollers 6, 6A, 6B and 6C are arranged so that run 50 juxtaposed surfaces 1, 1A is tensioned onto upstream surface 1, and deflected from its straight line path when reaching surface 1A to assure that there will be a bending of mail piece 4.

The aperture 2 is illustrated aligned with known optical character reader or bar code reader 51 line of view 5. Line of view 5 reaches the mail piece 4 at the point where mail piece 4 is deflected off surface 1A from its straight line path. Also illustrated is tension roller 52 and belt 3 continuing to tension mail piece 4 against downstream surface 1 after deflection appropriately missing aperture 2.

Figure 2:
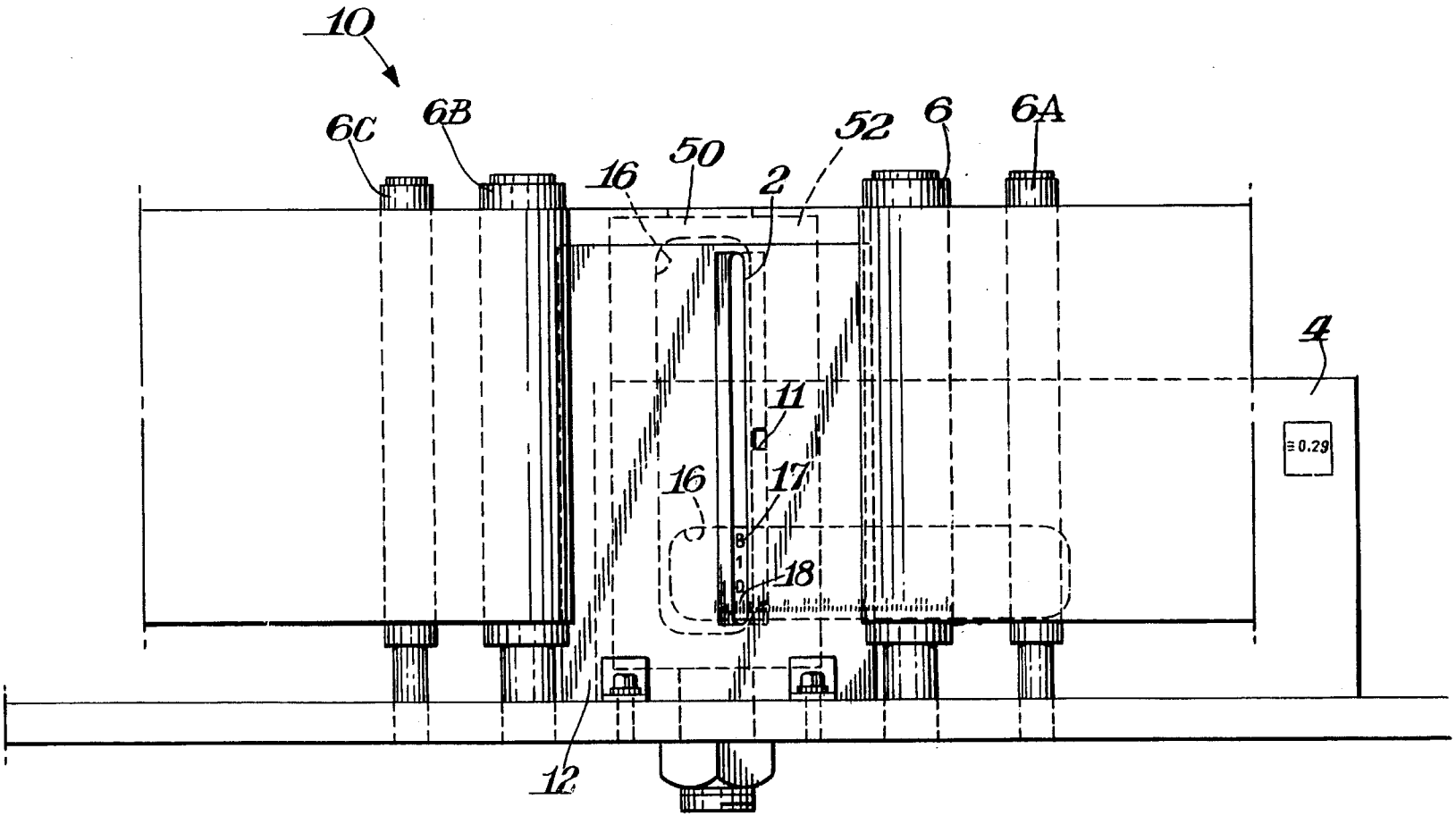
FIG. 2 is a side elevational view of the assembly of FIG. 1.

FIG. 2 illustrates the items of mail 4 to be moving in a downstream direction with the envelope 4 having a plastic window 16 through which addressee information 17 and bar code 18 are visible and are in line in a flow direction with aperture 2.

Any suitable tensioning device may be used for assuring the proper tension of belt 3 and roller 52 onto surfaces 1, 1A. In the illustrated embodiment the tension roller 52 is provided with a slotted adjustment ability (shown in phantom) to move roller 52 further from or closer to surfaces 1, 1A in accordance with the desired deflection of mail piece 4.

A particularly advantageous feature of the invention is the material of roller 52 and the movability of belt 3. In this respect, roller 52 is a sponge material and mail piece 4 would deflect roller 52 and belt 3 away from surface 1, 1A in accordance with the thickness of mail piece 4 and would retract upon the exit of mail piece 4 from surfaces 1, 1A.

Any suitable materials may be used for the components of mail aperture assembly 10. It is preferred, however, that a low friction material be used for surfaces 1, 1A to assure a high speed transition from upstream surface 1 to surface 1A and back to downstream surface 1 and minimize any hindrance to continuous transport along run 50.

Other features of mail aperture assembly 10 include an optional infra-red detection hole 11 at the upstream end of deflection plate 1A. Hole 11 would extend completely through the mail aperture plate 12 having the aligned planar surfaces 1,1. An infra-red detector (not shown) would be positioned to detect the arrival of an item of mail immediately prior to the item of mail reaching the aperture 2. This detection would be accomplished by directing the sensing beam from the detector to hole 11.

Where an infra-red detector hole 11 is used it is essential that the hole 11 be upstream from elongated aperture 2. In the preferred practice of the invention the deflection plate 1A includes a solid portion between the downstream edge of plate 1A and hole 11 to provide support for the item of mail as the item of mail passes over aperture 2.

The aperture plate 12 could be utilized as an add on feature to mail sorting systems by being mounted on the transport surface in any suitable manner, such as by being bolted to the transport surface at the conventional location of the aperture. The aperture 2 itself is formed by a slot in the plate, extending completely through plate 12.

An advantage of assembly 10 is to bend envelopes which along with the tension prevents ripples in the plastic window. Such ripples would otherwise reflect light back to the bar code reader 51 and interfere with accurate bar code reading. Reader 51 could also be an optical character reader or other suitable reader.

A particularly efficient mail aperture assembly 10 for viewing addresses and bar codes through envelopes is 91-5 Ultrasorter. This system would use the aperture assembly 10 to flatten plastic windowed envelopes in private and government industries. The flattening idea is also usable on an Electrocom mail transport assembly by modifying the existing aperture by adding a second surface not in the plane as the aperture. In an actual practice of the invention assembly 10 caused a 50% rate of reject read increase through the windowed envelope at the United States Postal Service, New Castle, Del. The two surface arrangement determines the shape of the mail piece when the assembly receives the individual items of mail.

Figure 4:
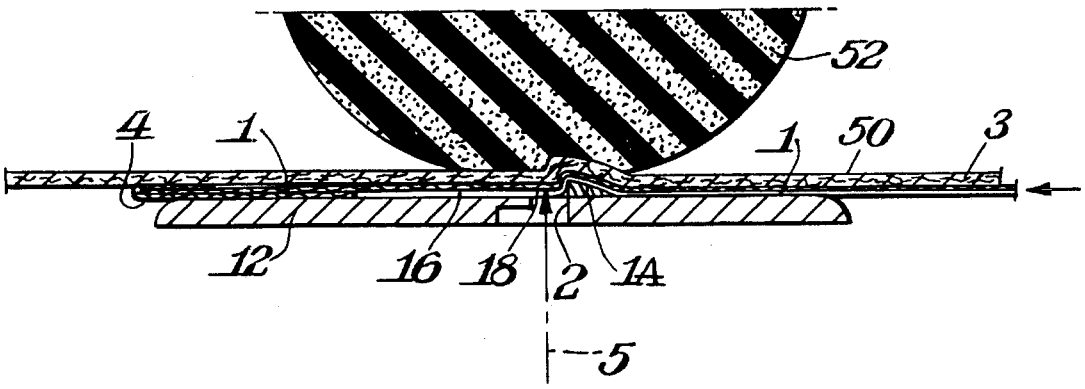
FIG. 4 is an enlarged cross-sectional plan view of the aperture assembly of FIGS. 1–3.

As best illustrated in FIGS. 3 and 4 the defector plate 1A has an inclined upstream ramp 13 which acts as a cam surface to cause the item of mail to immediately deflect out of the plane of the upstream planar surface 1. Deflector plate 1A then terminates in a sharp edge 15. Surface 1A could be a continuous curve or could have a flat surface beyond ramp 13 to permit the item of mail to again tend to resume an orientation generally parallel to surfaces 1. As the item of mail continues to move from right to left in an upstream to downstream direction of FIG. 4 the tension from belt 3 and roller 52 cause the item of mail 4 to again press against the downstream planar surface 1. When in the deflected condition at aperture 2 the envelope, and more particularly the window portion 16 of the envelope, presses against the contents of the envelope having the visible information to be read such as a bar code. This pressing action avoids the formation of any ripples in the window and assures avoiding light being reflected back to the reader so as to thereby avoid any interference with an accurate reading.

The concepts of the invention may be used in a mail sorter for reading any information such as optical character reading and bar code reading. While the invention is particularly useful for envelopes having plastic windows, the invention also assures the avoidance of ripples in opaque envelopes by avoiding ripples.

The transport assembly 10 could include, for example, an aperture 2 with various lengths in accordance with the optical character reader and bar code reader line of view 5. The width and height of aperture 2 and surfaces 1, 1A are not limited to the height of mail piece 4 and can accommodate the line of view 5 of various optical character reader and bar code reader.

While this invention has been described particularly for its adaptability to the 91-5 Ultrasorter and of the type of sorter disclosed in U.S. Pat. No. 5,226,547, the concepts of this invention may be used for other types of optical character reader and bar code reader mail sorters. It is possible, for example, to broadly practice the invention using only belt 3 for tensioning mail piece 4 onto surfaces 1,1A. Tension roller 52 would not be necessary because belt 3 would provide ample tension. It is also possible, for example, to broadly practice the invention using surface 1A as an addition to a mail transport assembly 10 that contains only one surface 1 and aperture 2.

As can be appreciated, the present system is particularly adapted to the handling of high speed windowed envelopes or plastic covered items of mail by creating a bend in the item of mail and causing the plastic window or plastic covering to flatten so that the optical character reader and bar code reader view the address and bar code information inside without glare caused by light from the optical character reader or bar code reader on the windowed envelope and plastic covered item of mail. Moreover, this is done by two surfaces in separate but parallel planes so as to slightly bend the item of mail and eliminate wrinkles that cause glare in the line of view of the optical character reader and bar code reader.

What is claimed is:

1. A mail aperture assembly of a mail sorting system having two surfaces in separate but parallel planes juxtaposed to an aperture so as to slightly bend an item of mail causing a plastic window and plastic covering to flatten against address and bar code information on contents inside an envelope eliminating wrinkles and folds and preventing an optical character reader and bar code reader light from creating glare in a line of view of said optical character reader and bar code reader on the contents inside the envelope.

2. In a high speed automated mail sorting system having a transport surface, drive means for driving items of mail one at a time in a downstream direction against said transport surface, and an optical character reader having a line of view directed toward said transport surface at a viewing location to read information on each item of mail passing through said viewing location, the improvement being in that an elongated aperture slot is located at said viewing location between said transport surface and said reader, a planar surface disposed juxtaposed downstream from said aperture slot parallel to said transport surface, a deflection surface juxtaposed upstream from said aperture slot for passing the items of mail between said transport surface on one side of the items of mail and said planar surface and said deflection surface on the other side of the items of mail, and said deflection surface extending toward said transport surface at an angle to said planar surface for deflecting each item of mail out of a straight line path to bend the item of mail and eliminate wrinkles and folds and to minimize the creation of glare to said reader.

3. The system of claim 2 wherein an upstream planar surface is disposed upstream juxtaposed to said deflection surface, and said upstream planar surface being co-planar to said downstream planar surface.

4. The system of claim 3 wherein said deflection surface is an inclined ramp functioning as a cam surface.

5. The system of claim 4 wherein said ramp surface terminates in a sharp edge at a said aperture slot.

6. The system of claim 5 wherein said planar surfaces and said deflection surface comprise surfaces on one side of a plate, and said aperture slot extending through said plate.

7. The system of claim 6 wherein said transport surface is a roller mounted belt, a tensioning roller mounted against said belt remote from said deflection surface, and said tensioning roller being made of a deformable material.

8. The system of claim 7 including an infra-red detector hole upstream from said aperture slot to detect the arrival of an item of mail immediately prior to the item of mail reaching said aperture slot.

9. The system of claim 2 wherein said deflection surface is an inclined ramp functioning as a cam surface.

10. The system of claim 9 wherein said ramp surface terminates in a sharp edge at a said aperture slot.

11. The system of claim 2 wherein said planar surface and said deflection surface comprise surfaces on one side of a plate, and said aperture slot extending through said plate.

12. The system of claim 2 wherein said transport surface is a roller mounted belt, a tensioning roller mounted against said belt remote from said deflection surface, and said tensioning roller being made of a deformable material.

* * * * *